US007739987B2

(12) United States Patent
Hoshikawa et al.

(10) Patent No.: US 7,739,987 B2
(45) Date of Patent: Jun. 22, 2010

(54) VARIABLE VALVE GEAR FOR AN INTERNAL COMBUSTION ENGINE

(75) Inventors: Jun Hoshikawa, Aichi-gun (JP); Hirofumi Higashi, Okazaki (JP); Akibiro Fujimoto, Nagoya (JP); Noritsugu Ohsawa, Anjo (JP); Tetsuji Tatsumi, Okazaki (JP); Tomoyuki Muraoka, Anjo (JP); Hideo Nakai, Suita (JP)

(73) Assignees: Mitsubishi Jidosha Kogyo Kabushiki Kaisha, Tokyo (JP); Mitsubishi Jidosha Engineering Kabushiki Kaisha, Aichi (JP)

( * ) Notice: Subject to any disclaimer, the term of this patent is extended or adjusted under 35 U.S.C. 154(b) by 59 days.

(21) Appl. No.: 12/277,127

(22) Filed: Nov. 24, 2008

(65) Prior Publication Data

US 2009/0241877 A1 Oct. 1, 2009

(30) Foreign Application Priority Data

Mar. 28, 2008 (JP) ..... 2008-086499

(51) Int. Cl.
*F01L 1/34* (2006.01)

(52) U.S. Cl. ..... 123/90.16; 123/90.39; 123/90.44; 123/90.31; 123/90.6

(58) Field of Classification Search ..... 123/90.16, 123/90.27, 90.31, 90.6, 90.39, 90.44, 193.3, 123/193.5; 29/888.1; 74/567, 559, 569
See application file for complete search history.

(56) References Cited

U.S. PATENT DOCUMENTS 7,603,973 B2 * 10/2009 Flierl et al. ..... 123/90.16

FOREIGN PATENT DOCUMENTS

| | | | |
|---|---|---|---|
| JP | 9-41923 | A | 2/1997 |
| JP | 10-280925 | A | 10/1998 |
| JP | 3494439 | B2 | 11/2003 |
| JP | 2005-180340 | A | 7/2005 |
| JP | 3758328 | B2 | 1/2006 |

* cited by examiner

*Primary Examiner*—Ching Chang
(74) *Attorney, Agent, or Firm*—Birch, Stewart, Kolasch & Birch, LLP

(57) ABSTRACT

The variable valve gear for an internal combustion engine includes a cam lobe that is rotatably supported by a cam drive shaft, and a variable valve mechanism that includes a drive arm fixed adjacent to one end of the cam lobe in the cam drive shaft, an eccentric shaft member that is swivelably supported at a position opposite to the cam lobe with respect to the drive arm in the cam drive shaft, has an outer circumferential surface eccentric to an axis of the cam drive shaft, and is adjustable in eccentricity, and an intermediate rotary member that is rotatably supported through a bearing member around the eccentric shaft member, and is connected to the drive arm, wherein the drive arm includes an end face that overlaps with an end face of the bearing member, when projecting along the axis of the cam drive shaft, and the end face of the drive arm is protruding further than the end face of the cam lobe toward the bearing member.

3 Claims, 6 Drawing Sheets

FIG. A4
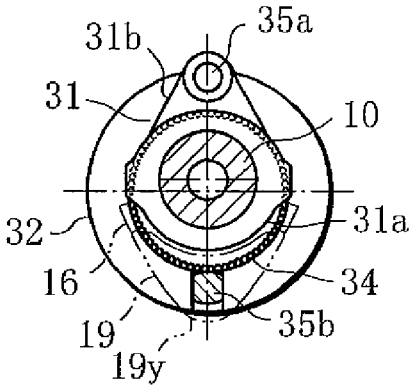
CAM-SHAFT
ROTATION ANGLE 0°
FIG. 4B
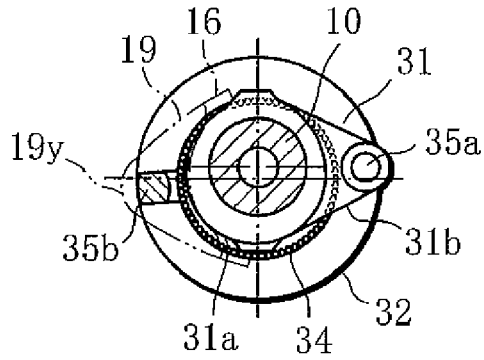
CAM-SHAFT
ROTATION ANGLE 90°
FIG. 4C
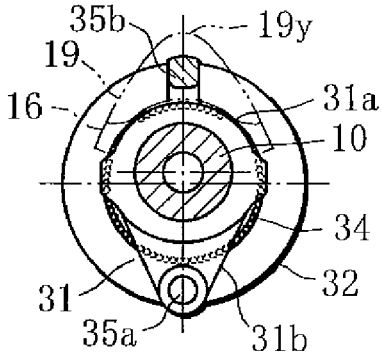
CAM-SHAFT
ROTATION ANGLE 180°
FIG. 4D
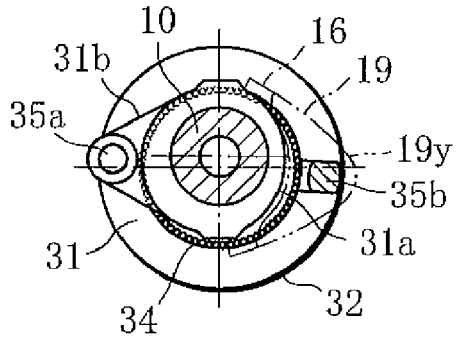
CAM-SHAFT
ROTATION ANGLE 270°

VARIABLE VALVE GEAR FOR AN INTERNAL COMBUSTION ENGINE

BACKGROUND OF THE INVENTION

1. Field of the Invention

The present invention relates to a variable valve gear for an internal combustion engine, which varies the open period of a valve.

2. Description of the Related Art

Regarding a reciprocating engine (internal combustion engine) installed in an automobile, a variable valve gear has been developed, which varies a valve-open-period according to the operational state of the engine in order to properly control the valve characteristics of intake and exhaust valves.

Many variable valve gears of this type have a configuration in which a cam lobe that is rotatably fitted onto the outer circumferential surface of a camshaft (cam drive shaft) supported by a cylinder head is combined with a valve-open-period variable mechanism that varies the rotational velocity of the camshaft at predetermined cycles to transmit the rotation to the cam lobe, as disclosed in Japanese Patent Gazette (Laid pen No. 10-280925). A lot of valve-open-period variable mechanisms have an Oldham coupling structure in which a drive arm is fixed onto the outer circumferential surface of the camshaft at a position adjacent to the cam lobe; an eccentric shaft is fitted to the outer circumferential surface of the camshaft at a position adjacent to the drive arm to be eccentrically rotatable; and a harmonic ring (intermediate rotary member) is rotatably fitted to the outer circumferential surface of the eccentric shaft. More specifically, the valve-open-period variable mechanism employs a structure that drives the valve by transmitting the constant velocity rotation of the camshaft, which is outputted from the drive arm, to the harmonic ring by using an input-side transmission member, changing the constant velocity rotation into non-constant velocity rotation that is changed in velocity at a predetermined cycle, and transmitting the rotation from a boss, which is protruding from the outer circumference of the end of the cam lobe, to the cam lobe by using an output-side transmission member. To phase-shift the axial position of the eccentric shaft from that of the camshaft adjusts a delay or advance of a rotational phase of the cam love relative to a rotational angle of the camshaft, and varies the valve-open period.

In order to place the valve-open-period variable mechanism in a limited area between each adjacent cylinders of the cylinder head, the mechanism has a structure in which the boss protruding from the outer circumferential surface of the end of the cam lobe is disposed close to a lateral portion of the drive arm in parallel with the lateral portion to carry out the transmission of the rotation from the harmonic ring, and the harmonic ring is supported by the eccentric shaft having a little larger external diameter than the camshaft located in the inside of an input gear portion of the variable mechanism.

As disclosed in the Japanese Patent Gazette, the valve-open-period variable mechanism is provided with a bearing portion such as a needle bearing in between the outer circumferential surface of the eccentric shaft and the inner circumferential surface of the harmonic ring for the purpose of smooth rotation of the harmonic ring.

The bearing portion can be displaced in an escaping direction, or more concretely, toward the cam lobe due to a change of the harmonic ring's movement (in result of a change in an eccentricity direction).

The displacement of the bearing portion disables the reliable support of the harmonic ring. Furthermore, the displacement causes abnormal abrasion. The bearing portion is disposed in a position eccentric to the camshaft to support the harmonic ring, and the boss of the cam lobe is located adjacent to the drive arm coaxially with the camshaft. Because of this displacement, the end face of the bearing portion repeatedly faces the end face of the drive arm and faces the end face of the boss of the cam lobe during the rotation of the harmonic ring. Especially the boss of the cam lobe is located outside the drive arm, so that the entire end face of the boss repeats a movement of deviating totally from the bearing portion to the outside and returning to the inside of the bearing portion. For this reason, if the end of the bearing portion, albeit slightly, projects from between the eccentric shaft and the harmonic ring, there generates such abnormal abrasion that the end of the bearing portion and the corner of the end face of the boss interfere with each other when the boss passes the end of the bearing portion.

The bearing portion can be prevented from escaping by employing a structure in which the bearing portion is fixed in between the harmonic ring and the eccentric shaft by press fitting or a structure in which a stopper is independently set in between the harmonic ring and the eccentric shaft.

In the case of the press fitting, however, it is difficult to reliably inhibit the axial movement of the bearing portion due to a high elastic deformability of the harmonic ring.

If the stopper is utilized, the bearing portion has to be made short in bearing length (strength decrease of the bearing portion) in order to secure a space for installing the stopper. In result, the sufficient support strength of the harmonic ring cannot be retained, which causes another problem.

A possible way of preventing the abnormal abrasion is to arrange the end face of the drive arm and that of the cam lobe to be flush with each other so that the boss smoothly passes between the end face of the bearing portion and that of the drive arm. Since the drive arm and the cam lobe are separate components and move differently, it is impossible to completely fit the end faces of these components together without a step or a gap. It is thus difficult to avoid the abnormal abrasion.

SUMMARY OF THE INVENTION

The present invention has been made in light of the foregoing issues. It is an object of the invention to provide a variable valve gear for an internal combustion engine, which restricts a bearing portion from moving in an escaping direction and prevents interference between the end of the bearing portion and the cam lobe with a simple structure that requires no alteration to the bearing portion and an intermediate rotary member.

The variable valve gear for an internal combustion engine according to the invention includes a cylinder head having an intake or exhaust valve; a cam drive shaft that is rotatably supported by the cylinder head; a cam lobe that is rotatably supported by the cam drive shaft and has a cam for driving the valve; and a variable valve mechanism that includes a drive arm fixed adjacent to one end of the cam lobe in the cam drive shaft, an eccentric shaft member that is swivelably supported at a position opposite to the cam lobe with respect to the drive arm in the cam drive shaft, has an outer circumferential surface eccentric to an axis of the cam drive shaft, and is adjustable in eccentricity, and an intermediate rotary member that is rotatably supported through a bearing member around the outer circumferential surface of the eccentric shaft member and is connected to the drive arm, the variable valve mechanism being capable of varying an open period of the valve by transmitting the rotation of the cam drive shaft through the drive arm and the intermediate rotary member to the cam lobe and adjusting the eccentricity of the eccentric shaft member.

The drive arm includes an end face that overlaps with an end face of the bearing member, regardless of a rotational position of the drive arm relative to the eccentric shaft member, when projecting along the axis of the cam drive shaft. The end face of the drive arm is protruding further than the end face of the cam lobe toward the bearing member.

With this structure, the drive arm surely faces somewhere in the end face of the bearing member, regardless of the rotational position of the drive arm relative to the eccentric shaft member. The end face of the bearing member therefore restricts the bearing member from moving in an escaping direction and suppresses an unnecessary displacement of the bearing member. Even if the end of the bearing member is slightly protruding, it merely hits against the end face of the drive arm and is prevented from interfering with other portions of the cam lobe without fail. Furthermore, it is possible to accomplish the object with a simple structure that requires no alteration to the bearing member and the intermediate rotary member.

In a preferable aspect of the invention, the drive arm has a fixed ring that is fixed to the cam drive shaft, and an arm portion that extends from an outer circumference of the fixed ring in a radially outward direction and transmits torque to the intermediate rotary member. A bearing-side end face of the fixed ring overlaps with the end face of the bearing member in the drive arm.

With this structure, the bearing member is restricted from moving in the escaping direction because of the end face of the fixed ring of the drive arm. Even if the end of the bearing member is slightly protruding, it merely hits the end face of the fixed ring of the drive arm, and interference between the cam lobe and the drive arm can be prevented without fail. Moreover, the object can be accomplished with a simple structure in which the fixed ring is merely altered in shape.

In a further preferable aspect, the cam lobe has a boss, to which the torque of the intermediate rotary member is transmitted, in a position that diverges from an axis of the cam lobe. The boss extends toward the intermediate rotary member. The cam lobe has a contact face that comes into contact with the cam lobe-side end face of the fixed ring of the-drive arm and determines an axial position of the cam lobe relative to the drive arm. The fixed ring of the drive arm has axial length longer than axial length between the contact face of the cam lobe and a tip end-side face of the boss.

With this structure, the contact face of the cam lobe and the cam lobe-side end face of the drive arm are brought into contact with each other, and by so doing, the axial positions and axial lengths of the cam lobe and the drive arm are determined. This makes it possible to accurately set a protruding amount of the end face of the fixed ring of the drive arm from the end face of the boss of the cam lobe. Consequently, the end face of the boss and the intermediate rotary member are disposed as close as possible to each other, so that force can be smoothly transmitted from the intermediate rotary member to the boss.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 4A to 4D are an explanatory view showing the trajectories of a drive arm and a boss moving on an end face of a bearing portion of the variable valve gear;

DETAILED DESCRIPTION OF THE PREFERRED EMBODIMENTS

The present invention will be described below with reference to one embodiment shown in FIGS. 1 to 6.

Figure 1:
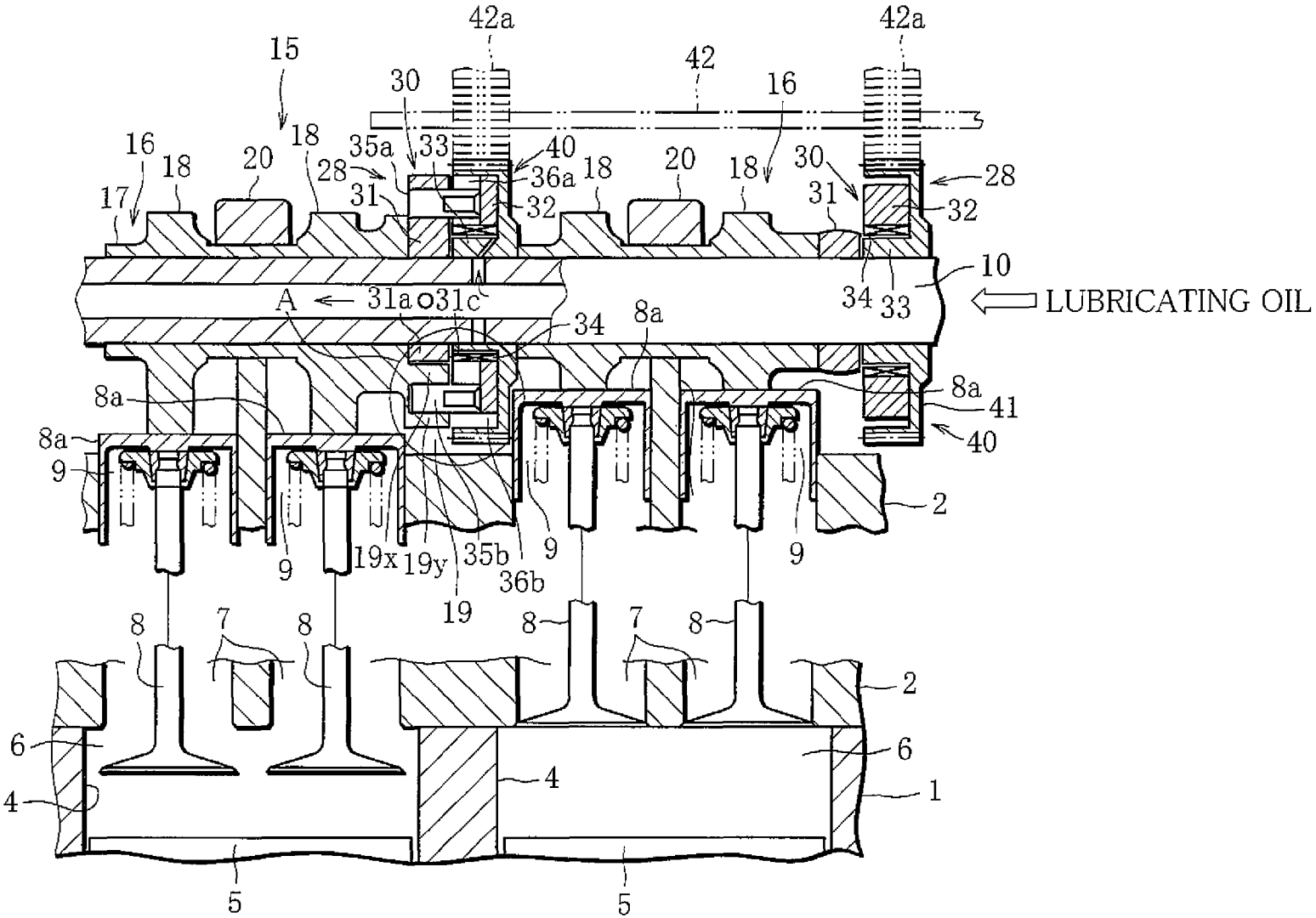
FIG. 1 is a cross-sectional view showing a variable valve gear for an internal combustion engine according to one embodiment of the invention.

FIG. 1 is a cross-sectional view showing an internal combustion engine in which a variable valve gear is installed, for example, in an intake-side valve operating system of the engine. Reference mark 1 in FIG. 1 represents a cylinder block of the internal combustion engine, for example, a cylinder block (shown only in FIG. 1) of a 4-cylinder reciprocal gasoline engine (hereinafter, referred to as engine). Reference mark 2 denotes a cylinder head mounted on a head of the cylinder block 1.

First, the basic configuration of the engine will be explained. In the cylinder block 1, there are formed four cylinders 4 (FIG. 1 shows only some of the cylinders) to be serially arranged in an anteroposterior direction of the engine. A piston 5 is reciprocatably accommodated in each of the cylinders 4. Although not shown, the piston 5 is connected to a crankshaft through a connecting rod.

Under the cylinder head 2, combustion chambers 6 are formed correspondingly to the cylinders 4. In the combustion chamber 6, there are formed a pair of intake ports 7 and a pair of exhaust ports, not shown. The combustion chamber 6 also accommodates two intake valves 8 (corresponding to a valve of the invention) for opening/closing the intake ports 7, and two exhaust valves, not shown, for opening/closing the exhaust ports. Both the intake valves 8 and the exhaust valves are normally-closed valves that are closed by valve springs 9. Although not shown, there is also disposed an ignition plug in the combustion chamber 6 so that predetermined combustion cycles (four cycles including an intake stroke, a compression stroke, an explosion stroke, and an exhaust stroke) are repeated.

An intake camshaft 10 (corresponding to a cam drive shaft of the invention) and an exhaust camshaft, not shown, are arranged in an upper portion of the cylinder head 2 along a direction in which the cylinders 4 are aligned. The intake camshaft 10 and the exhaust camshaft are connected to a crank shaft end, not shown, through a timing chain member, not shown, or the like. The intake camshaft 10 and the exhaust camshaft are rotationally driven by shaft output that is outputted from the crank shaft.

As illustrated in FIG. 1, a variable valve gear 15 is mounted on the intake camshaft 10 of the engine. The variable valve gear 15 has a variable structure that changes the constant velocity rotation of the camshaft into the non-constant velocity rotation to vary an open period of the intake valve 8. The variable structure is constructed of a cam lobe 16 that is rotatably fitted onto an outer circumferential surface of the intake camshaft 10 with respect to each cylinder 4, and an eccentric rotation-type valve-open-period variable mechanism 28 that is mounted on the cam lobe 16.

Figure 2:
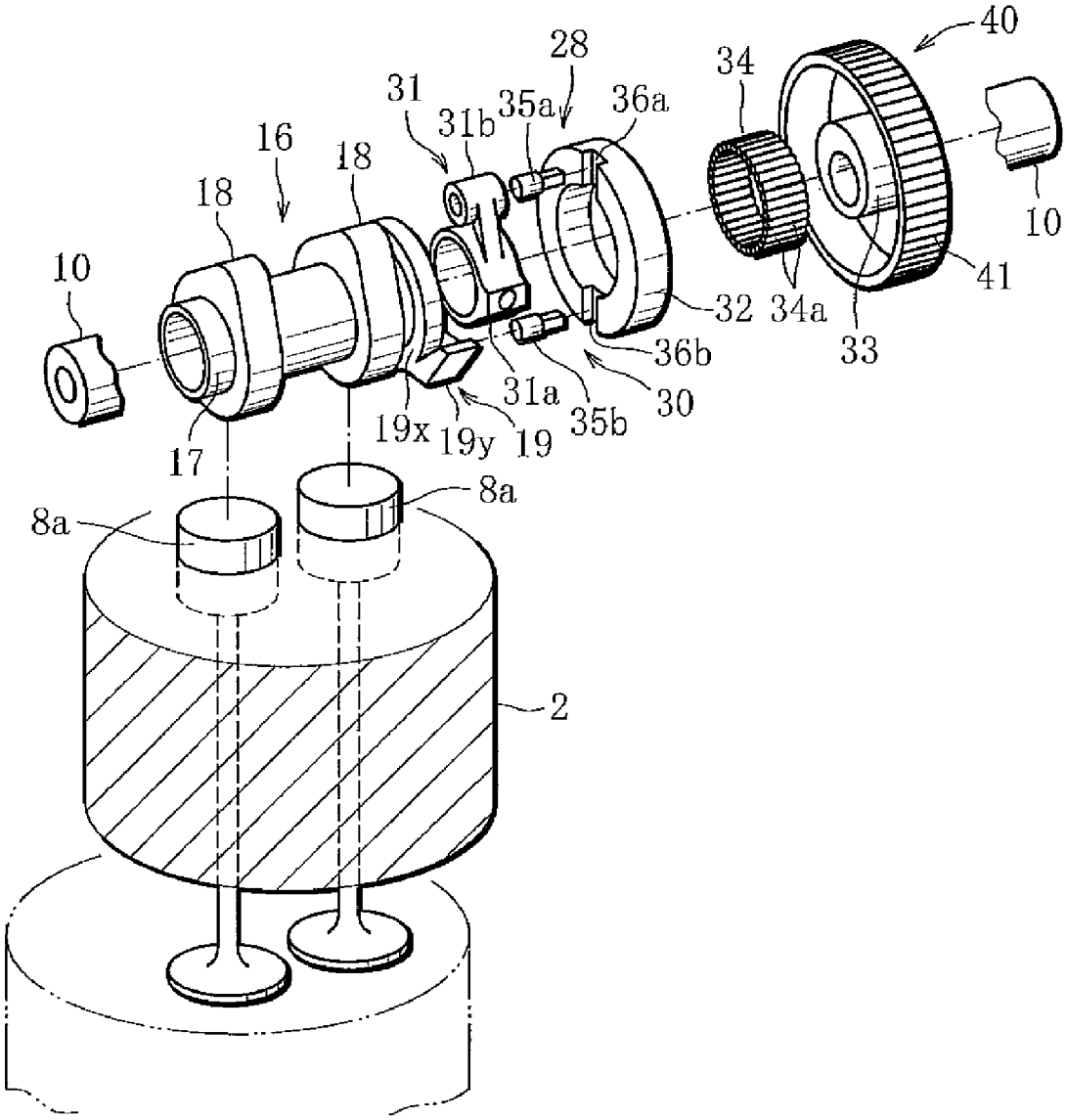
FIG. 2 is an exploded perspective view showing the configuration of a substantial part of the variable valve gear.

FIG. 2 is an exploded perspective view showing the cam lobe 16 and the valve-open-period variable mechanism 28 for one cylinder.

Each part of the variable structure will be explained with reference to this particular cylinder shown in FIG. 2. The cam lobe 16 has a cylindrical main body 17 that is rotatably fitted onto the outer circumferential surface of the intake camshaft 10, a pair of (a plurality of) cam portions 18 formed in an outer circumferential surface of the main body 17, and a boss 19 protrudingly formed in an outer circumference of one end of the main body 17, which is located adjacent to the cam portions 18. The outer circumferential surface between the cam portions 18 is rotatably supported by a bearing placed in between the intake valves 8 (shown only in FIG. 1).

The boss 19 is formed into a triangular plate as shown by chain double-dashed line in FIGS. 2 and 4A to 4D. To be concrete, the boss 19 is formed of a block of the triangular piece in which a root portion 19*x* is protruding from the outer circumference of an end face of the main body 17 toward the end, or more specifically, in a forward direction, and a top portion 19*y* that is a tip end extends in a radial direction of the main body 17.

A cam face of each of the cam portions 18 is in direct contact with a valve lifter 8*a* mounted on a receiving portion of the intake valve 8, for example, a base end of the intake valve 8, so that the intake valve 8 can be driven with the cam portion 18.

The valve-open-period variable mechanism 28 includes a non-constant velocity mechanism 30 and a period setting section 40 that sets the valve-open period. The non-constant velocity mechanism 30 is a mechanism that changes the constant velocity rotation of the intake camshaft 10 into non-constant velocity rotation to transmit the rotation to the cam lobe 16. To be specific, the non-constant velocity mechanism 30 is formed of an Oldham coupling.

In other words, as illustrated in FIGS. 1 and 2, the coupling includes a drive arm 31 that is disposed in the intake camshaft adjacent to the end face of a boss 19-side end of the cam lobe 16; an eccentric shaft 33 that is rotatably fitted onto the outer circumferential surface of the intake camshaft 10 adjacent to the drive arm 31; a harmonic ring 32 serving as an intermediate rotary member, which is fitted onto an outer circumferential surface of the eccentric shaft 33; and a bearing portion, for example, a needle bearing 34, which is interposed between the outer circumferential surface of the eccentric shaft 33 and an inner circumferential surface of the harmonic ring 32.

The needle bearing 34 has a structure in which a bearing body obtained simply by holding a large number of needles 34*a* with a cage, not shown, is fitted to the outer circumferential surface of the eccentric shaft 33, and the harmonic ring 32 is fitted onto an outer circumference of the bearing body to rotatably support the harmonic ring 32. The needle 34*a* has maximum length obtained by subtracting length required for forming the cage from length of opposite cylindrical faces of the eccentric shaft 33 and the harmonic ring 32.

The eccentric shaft 33 is made of a shaft member having a slightly larger external diameter than the intake camshaft 10. The outer circumferential surface of the shaft member is eccentric to an axis of the intake camshaft 10, and the harmonic ring 32 rotates on the outer circumferential surface of the eccentric shaft member being in the eccentric state.

The drive arm 31 has a fixed ring 31*a* that is fitted onto the outer circumferential surface of the camshaft portion and an arm portion 31*b* radially protruding from a position in the fixed ring 31*a*, which is deviated from the boss 19 at an angle of 180 degrees. The fixed ring 31*a* is (coaxially) fixed to the intake camshaft 10 with a fixing member, for example, a pin member 29 (partially shown in FIG. 1). The drive arm 31 is set in a position adjacent to the end face of the cam lobe 16. The boss 19 of the cam lobe 16 is disposed next to a lateral portion of the fixed ring 31*a*, which is in the opposite side to the arm portion 31*b*. The boss 19 is placed in a position adjacent to a lateral portion of the drive arm 31 in parallel with the lateral portion. The entire boss 19 is compactly arranged around the end of the drive arm 31.

An end portion of either one of relay pins 35*a* and 35*b* is rotatably inserted in the end face of a tip end portion of the arm portion 31*b* and the end face of the boss 19. The end portion of the relay pin 35*a* (input-side transmission member) protruding from the arm portion 31*b* is slidably inserted in a slide groove 36*a* formed in an end face of the harmonic ring 32 so as to extend in a radial direction. The end portion of the relay pin 35*b* (output-side transmission member) protruding from the boss 19 passes by the fixed ring 31*a* and is slidably inserted in a slide groove 36*b* formed in a position deviated from the slide groove 36*a* at an angle of 180 degrees so as to extend in a radial direction.

By so doing, the rotation of the intake camshaft 10 is transmitted from the drive arm 31 through the relay pin 35*a* to the harmonic ring 32, and further transmitted from the harmonic ring 32 through the relay pin 35*b* and the boss 19 to the cam lobe 16. In other words, the rotation of the intake camshaft 10 is transmitted to the cam lobe 16 after being turned into the rotation that is varied in speed at a predetermined cycle as shown by solid or broken lines in FIG. 5(*b*) through the harmonic ring 32 that eccentrically rotates around the eccentric shaft 33 (around the intake camshaft 10) as illustrated in (a) and (b) of FIG. 5 while making delay and advancement.

Figure 3:
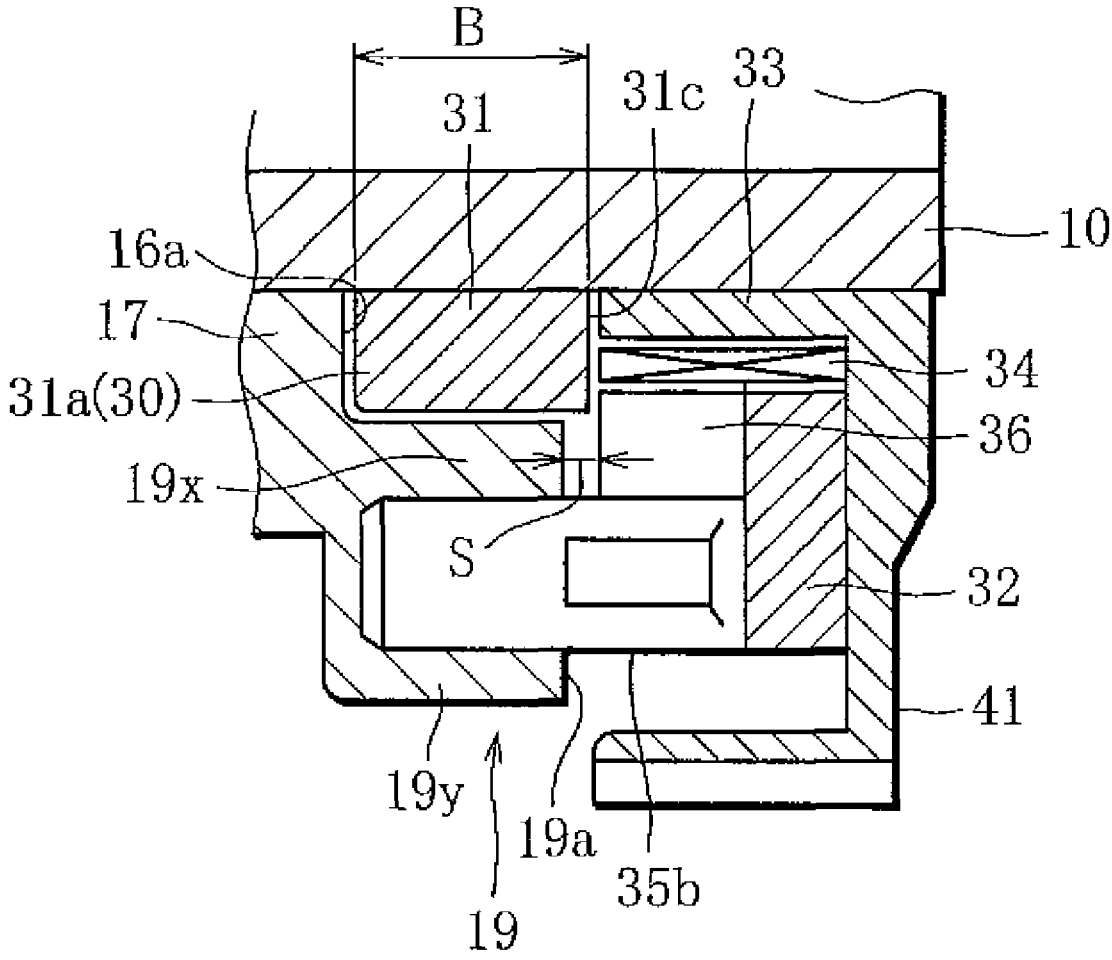
FIG. 3 is a cross-sectional view showing a part surrounded by circle A in FIG. 1, in an enlarged scale.

In view of the disposition of the eccentric shaft 33, the harmonic ring 32—side end face of the fixed ring 31*a* of the drive arm 31 is designed to be an end face 31*c* (corresponding to the end face portion of the invention) that continues to overlap with an end face of the needle bearing 34 when the rotation is transmitted from the intake camshaft 10 to the cam lobe 16. The end face of the fixed ring 31*a* is so formed as to overlap with the end face of the needle bearing 34, regardless of a rotational position of the drive arm 31 relative to the eccentric shaft 33, when projecting along the axis of the camshaft 10. As illustrated in FIGS. 1 and 3 (figures in which a part surrounded by circle A in FIG. 1 is shown in an enlarged scale), the end face 31*c* is protruding from the end face of the boss 19 toward the needle bearing 34. Distance S between the boss 19 and the harmonic ring 32 is preferably as short as possible. This is because the relay pin 35*b* can be screwed with a small force, that is, torque can be smoothly transmitted from the harmonic ring 32 to the boss 19, if the distance S is small.

For this reason, the present embodiment is constructed as stated below. As is apparent from FIG. 3, the main body 17 of the cam lobe 16 has a contact face 16*a* that comes into contact with the left end face of the fixed ring 31*a* of the drive arm 31 as viewed into the figure to carry out the axial positioning of the cam lobe 16 relative to the drive arm 31. This enables the accurate relative positioning of the cam lobe 16 and the drove arm 31. The fixed ring 31*a* has an axial length B that is set slightly longer than an axial length between the end face 16*a* of the cam lobe 16 and an end face 19*a* of the tip end of the boss 19. Accordingly, the amount in which the end face 31*c* of the fixed ring 31*a* of the drive arm 31 is protruding further than the end face 16*a* of the cam lobe 16 can be set with high accuracy. That is to say, the distance S can be set as short as possible.

The period setting section 40 has a structure in which an input gear 41 is integrally fitted in the eccentric shaft 31 as illustrated in FIGS. 1 and 2. The input gear 41 is formed of a circular gear that is coaxial with the intake camshaft 10. When the setting of the valve-open period is inputted from the input gear 41, the axis of the eccentric shaft 31 is eccentrically shifted around the axis of the intake camshaft 10. Each part of the period setting section 40 is set in a correlation with maximum lifting time of the intake valve 8 as illustrated in (a) to (c) of FIG. 5. Assuming that an eccentric phase is set at an angle of zero degree (upper eccentricity) in which an axial position β of the eccentric shaft 31 is aligned above an axial position α a of the intake camshaft 10 (opposite side to the valve) as illustrated in (c) of FIG. 5, a rotational phase of a cam mountain portion 18 relative to a rotational angle of the camshaft 10 advances at maximum when the camshaft 10 is at an angle falling in a range of from zero degree to 180 degrees, and delays at maximum when the camshaft 10 is at an angle falling in a range of from 180 degrees to 360 degrees. Consequently, the valve-open period is longest in the case of the upper eccentricity. To the contrary, as illustrated in (a) of FIG. 5, if the eccentric phase is set at an angle of 180 degrees (lower eccentricity) in which the axial position β of the eccentric shaft 31 is aligned under the axial position a of the intake camshaft 10 (valve side), the rotational phase of the cam mountain portion 18 relative to the rotational angle of the camshaft 10 delays at maximum when the camshaft 10 is at an angle falling in a range of from zero degree to 180 degrees, and advances at maximum when the camshaft 10 is at an angle falling in a range of from 180 degrees to 360 degrees. The valve-open period is shortest in the case of the upper eccentricity. In this manner, the valve-open period can be changed between both the positions, namely, angles between zero degree and 180 degrees, according to the eccentric phase.

The input gear 41 is engaged with a gear 42*a* of a control shaft 42 (operating member) as shown by chain double-dashed line in FIG. 1. When an actuator, not shown, which is connected to the control shaft 42 is controlled according to an engine operational state, the eccentric position of the harmonic ring 32 is varied along with the engine operational state, and the valve-open period of the intake valve 8 of each cylinder 4 can be adjusted.

Operation will be explained below.

Figure 5:
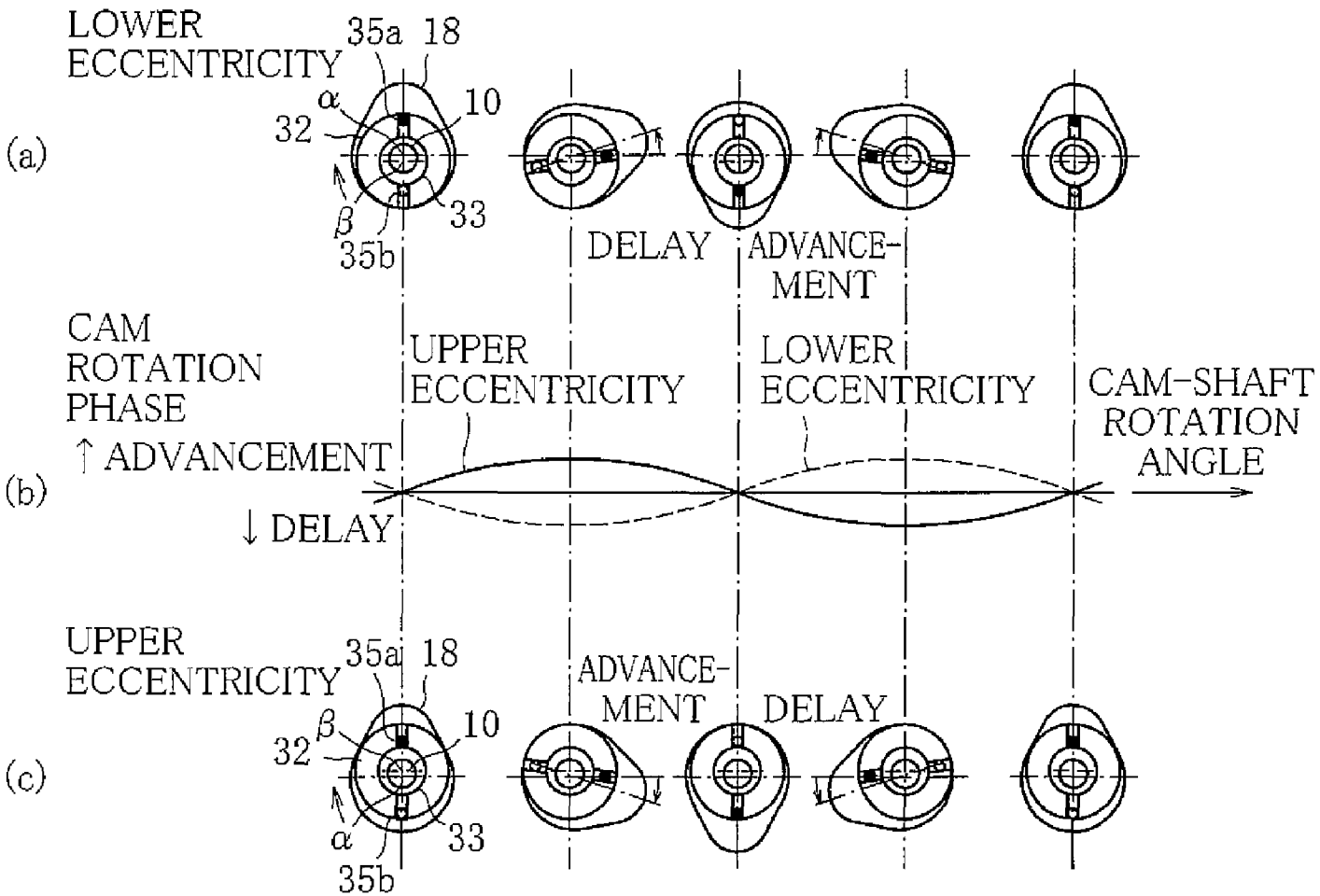
FIG. 5 is an explanatory view of operating characteristics of the variable valve gear.
Figure 6:
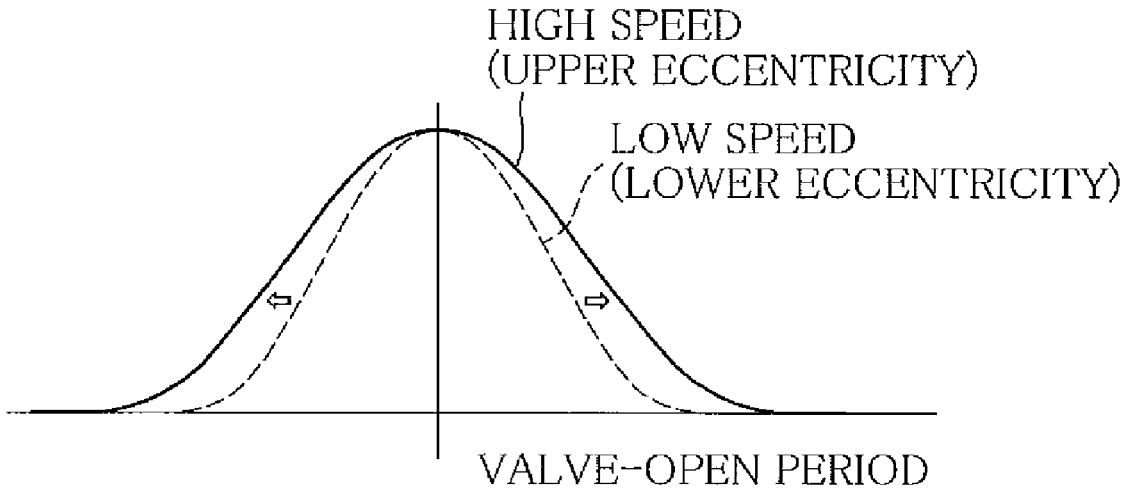
FIG. 6 is a line map for explaining changes of a valve-open period, which is obtained according to the operating characteristics.

In the variable valve gear 15 of the engine thus constructed, the axial position β of the intake-side eccentric shaft 33 is set at an eccentric phase angle of zero degree that is upper than the axial position α of the intake camshaft 10 by using the actuator, not shown, as illustrated in (c) of FIG. 5. The eccentric position of the harmonic ring 32 is thus positioned at a predetermined position.

The cam portion 18 passing through the intake valve 8 of each cylinder 4 is displaced to advance at maximum during the valve-open period and to delay at maximum during a valve-closed period as mentioned above. As shown by solid line in FIG. 6, the intake valve 8 is opened and closed with such characteristic that the valve-open period is long, which is appropriate for high-speed driving of the engine.

To the contrary, the axial position β of an intake-side eccentric shaft 25 is set at an eccentric phase angle of zero degree that is lower than the axial position α of the intake camshaft 10 as illustrated in (a) of FIG. 5 by using the actuator. The eccentric position of the harmonic ring 32 is thus positioned at a predetermined position.

Consequently, the cam portion 18 passing through the intake valve 8 of each cylinder 4 is displaced to delay at maximum during the valve-open period and to advance at maximum during the valve-closed period as mentioned above. As shown by broken line in FIG. 6, the intake valve 8 is opened and closed with such characteristic that the valve-open period is short, which is appropriate for low-speed driving of the engine. Needless to say, if the eccentric phase angle of the eccentric shaft 33 is varied within a range of from zero degree to 180 degrees, the valve-open period of the intake valve 8 is varied between the valve characteristic of the minimum valve-open period which is shown by broken line in FIG. 5 and the valve characteristic of the maximum valve-open period which is shown by solid line in FIG. 5.

During the control on the valve-open period, for example, as symbolically shown by a state in which the axial position β of the eccentric shaft 33 shown in FIGS. 4A to 4D is set under the axial position α of the intake camshaft 10, a rinq-like end face of the needle hearing 34 repeats facing the end face of the drive arm 31 and facing the end face of the boss 19 of the cam lobe 16 while the harmonic ring 32 is rotated. Being disposed outside the drive arm 31, the boss 19 of the cam lobe 16 repeats such movement that the entire end face of the boss 19 totally deviates from the ring-like end face of the needle bearing 34 in an outward direction and returns to the inside of the needle bearing 34.

At this time point, only the end face 31*c* of the drive arm which continues to overlap with the ring-like end face of the needle bearing 34 is protruding toward the needle bearing 34 further than the end face of the boss 19. If the needle bearing 34 moves in such a direction as to escape due to a change in the eccentricity direction of the harmonic ring 32, there is the constantly-protruding end face 31*c* adjacently to the end face of the needle bearing 34 as illustrated in FIG. 3, so that the ring-like end face of the needle bearing 34 faces somewhere in the end face 31, and the movement of the needle bearing 34 in the escaping direction is regulated. This prevents an unnecessary movement of the needle bearing 34, so that the harmonic ring 32 can be firmly borne all the time.

Even if the end of the needle bearing 34, albeit slightly, projects toward the cam lobe 16, the end of the needle bearing 34 merely hits against the protruding end face 31*c* as illustrated in FIG. 3 and is therefore regulated in movement, rather than contacts a corner 19*c* of the end face of the boss 19, which is located in a position retreating from the end face 31*c*. Abnormal abrasion is then prevented.

It is therefore possible to suppress the movement of the needle bearing 34 in the escaping direction and to prevent interference between the end of the needle bearing 34 and the boss 19 of the cam lobe 16 with a simple structure that requires no alteration to the needle bearing 34, the harmonic ring 32, and the eccentric shaft 33. As the protruding end face 31*c* is formed simply by increasing the thickness dimension of the drive arm 31, or more specifically, the thickness dimension of the fixed ring 31*a*, this particularly allows the simple structure.

Since the needle bearing 34 is not applied with load from outside, it is possible to employ a needle 34*a* having a maximum length within a limited space between the harmonic ring 32 and the eccentric shaft 33. Consequently, a supporting strength of the harmonic ring 32 can be sufficiently secured.

The invention is not limited to the one embodiment described above. Various modifications can be made without deviating from the gist of the invention. For example, the one embodiment increases the width dimension of the fixed ring to project the end face that continues to overlap with the end face of the bearing portion. Needless to say, however, it is also possible to design the end face to expand from the fixed ring through to the arm portion and increase the width dimension of the same part so as to project the end face that continues to overlap with the end face of the bearing portion. Although the one embodiment uses a needle bearing as the bearing portion, another bearing such as a slide bearing may be used. The one embodiment has the structure in which the eccentric rotation-type variable valve gear is installed in the intake side of the engine, and the invention is applied to this gear. However, the invention may be applied to an eccentric rotation-type variable valve gear that is installed in the exhaust side of the engine.

What is claimed is:

1. A variable valve gear for an internal combustion engine, comprising:

a cylinder head having an intake or exhaust valve;

a cam drive shaft that is rotatably supported by the cylinder head;

a cam lobe that is rotatably supported by the cam drive shaft and has a cam for driving the valve; and a variable valve mechanism that includes a drive arm fixed adjacent to one end of the cam lobe in the cam drive shaft, an eccentric shaft member that is swivelably supported at a position opposite to the cam lobe with respect to the drive arm in the cam drive shaft, has an outer circumferential surface eccentric to an axis of the cam drive shaft, and is adjustable in eccentricity, and an intermediate rotary member that is rotatably supported through a bearing member around the outer circumferential surface of the eccentric shaft member and is connected to the drive arm, the mechanism transmitting the rotation of the cam drive shaft through the drive arm and the intermediate rotary member to the cam lobe, adjusts the eccentricity of the eccentric shaft member, and then varies a valve-open period of the valve, wherein the drive arm includes an end face that overlaps with an end face of the bearing member, regardless of a rotational position of the drive arm relative to the eccentric shaft member, when being projected along the axis of the cam drive shaft, and the end face of the drive arm is protruding further than an end face of the cam lobe toward the bearing member.

2. The variable valve gear for an internal combustion engine according to claim 1, wherein:

the drive arm has a fixed ring that is fixed to the cam drive shaft, and an arm portion that extends from an outer circumference of the fixed ring in a radially outward direction and transmits torque to the intermediate rotary member; and a bearing-member-side end face of the fixed ring overlaps with the end face of the bearing member in the drive arm.

3. The variable valve gear for an internal combustion engine according to claim 2, wherein:

the cam lobe has a boss, to which the torque of the intermediate rotary member is transmitted, in a position that diverges from an axis of the cam lobe, the boss extending toward the intermediate rotary member;

the cam lobe has a contact face that comes into contact with the cam lobe-side end face of the fixed ring of the drive arm and determines an axial position of the cam lobe relative to the drive arm; and the fixed ring of the drive arm has axial length longer than axial length between the contact face of the cam lobe and a tip end-side face of the boss.

* * * * *